United States Patent [19]

Chalpin, Jr.

[11] 4,194,325

[45] Mar. 25, 1980

[54] GUTTER SYSTEM FOR SKYLIGHTS OR THE LIKE

[75] Inventor: Stephen F. Chalpin, Jr., Overland Park, Kans.

[73] Assignee: Butler Manufacturing Company, Kansas City, Mo.

[21] Appl. No.: 950,709

[22] Filed: Oct. 12, 1978

[51] Int. Cl.[2] ..... E04D 13/00

[52] U.S. Cl. ..... 52/14; 52/126; 52/200

[58] Field of Search ..... 52/15, 14, 13, 11, 126, 52/200

[56] References Cited

U.S. PATENT DOCUMENTS

| | | | |
|---|---|---|---|
| 228,282 | 6/1880 | Smith | 52/200 |
| 2,978,758 | 4/1961 | Dunn | 52/13 |
| 3,307,302 | 3/1967 | Gutierrez | 52/14 |
| 3,611,649 | 10/1971 | Muller | 52/14 |
| 3,735,596 | 5/1973 | Stephenson | 52/13 |

FOREIGN PATENT DOCUMENTS

| | | | |
|---|---|---|---|
| 1255896 | 12/1967 | Fed. Rep. of Germany | 52/11 |
| 1006488 | 10/1965 | United Kingdom | 52/200 |

*Primary Examiner*—John E. Murtagh

*Attorney, Agent, or Firm*—Shoemaker and Mattare, Ltd.

[57] ABSTRACT

A gutter system for skylights or the like which includes a formed or extruded primary gutter and a channel connector shop welded across the primary gutter at locations where a secondary gutter is desired. A secondary gutter is nested in the connector and is attached thereto. The channel connector has a drain hole defined therein for conducting water from the secondary gutter to the primary gutter.

12 Claims, 7 Drawing Figures

GUTTER SYSTEM FOR SKYLIGHTS OR THE LIKE

BACKGROUND OF THE INVENTION

The present invention relates in general to gutters, and, more particularly, to gutters used in skylights.

Many buildings use skylights for aesthetic or other purposes. One type of skylight includes a plurality of panels which can be flat, dome-shaped, pyramidal, or any other suitable or desirable shape. Skylights require gutter systems if water is to be suitably conducted to proper disposal systems. The gutter systems, especially those used with skylights having a plurality of panels, include a plurality of intersecting gutters. Intersections in guttering systems, especially those used with small skylights, may become quite involved.

Commonly, the gutter intersections are field welded or connected with fasteners which are then exposed inside the building. Other gutter intersections include gaskets, or the like.

Gaskets may have weather induced problems, and fasteners may require subsequent touch-up or other such finishing to preserve aesthetic appeal for the skylight. Both of these drawbacks may result in extra costs, waste of labor, or the like.

Other structures for controlling water around skylights include gutter systems in the purlins, rafters, or other support structure adjacent the skylight, and lapped panels. These structures suffer the drawbacks of requiring special panels or special support structures which may prove costly and/or time consuming to erect.

Accordingly, there is need for a gutter system which can be set up quickly while eliminating the use of field welding and subsequent touchup without requiring use of special building structural members.

SUMMARY OF THE INVENTION

The gutter system embodying the teachings of the present invention is easily set up and has gutter intersections which are easily effected.

The gutter system includes a plurality of formed or extruded primary gutters and a plurality of formed or extruded channel connectors of lesser depth than the primary gutters. The connectors are shop welded across the primary gutters at locations where secondary gutters are desired. A drain hole is provided in the channel connector for transferring water from the secondary gutter to the intersected primary gutter. A plurality of secondary gutters each having a depth slightly less than the depth of the channel connectors are nested in the channel connectors and are connected together by the channel connectors to form the secondary gutter system. Preferably, the primary and secondary gutters are orthogonally oriented with respect to each other, but other orientations are possible.

The primary gutter is formed in a shop and has notches defined in the walls thereof. The notches accommodate the channel connectors, and the channel connector top edges are coplanar and flush with the top edges of the primary and secondary gutters.

The gutter intersections embodied by the system embodying the teachings of the present invention eliminate field welding and subsequent field touchup or finish. Gaskets are also eliminated, and fasteners do not need to be weathertight. Sealants are used at the gutter intersections, and are not exposed to weather, and hence do not suffer the deleterious effects caused by exposure to the weather. Furthermore, components can be factory finished and installed without damaging that finish.

OBJECTS OF THE INVENTION

It is therefore a main object of the present invention to provide a gutter system for skylights and the like which is easily set up.

It is another object of the present invention to supply a gutter system for skylights and the like wherein field welding is not required to set up that gutter system.

It is yet another object of the present invention to provide a gutter system for skylights and the like wherein gaskets are eliminated.

It is still another object of the present invention to provide a gutter system for skylights and the like wherein sealants are not exposed to weather.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
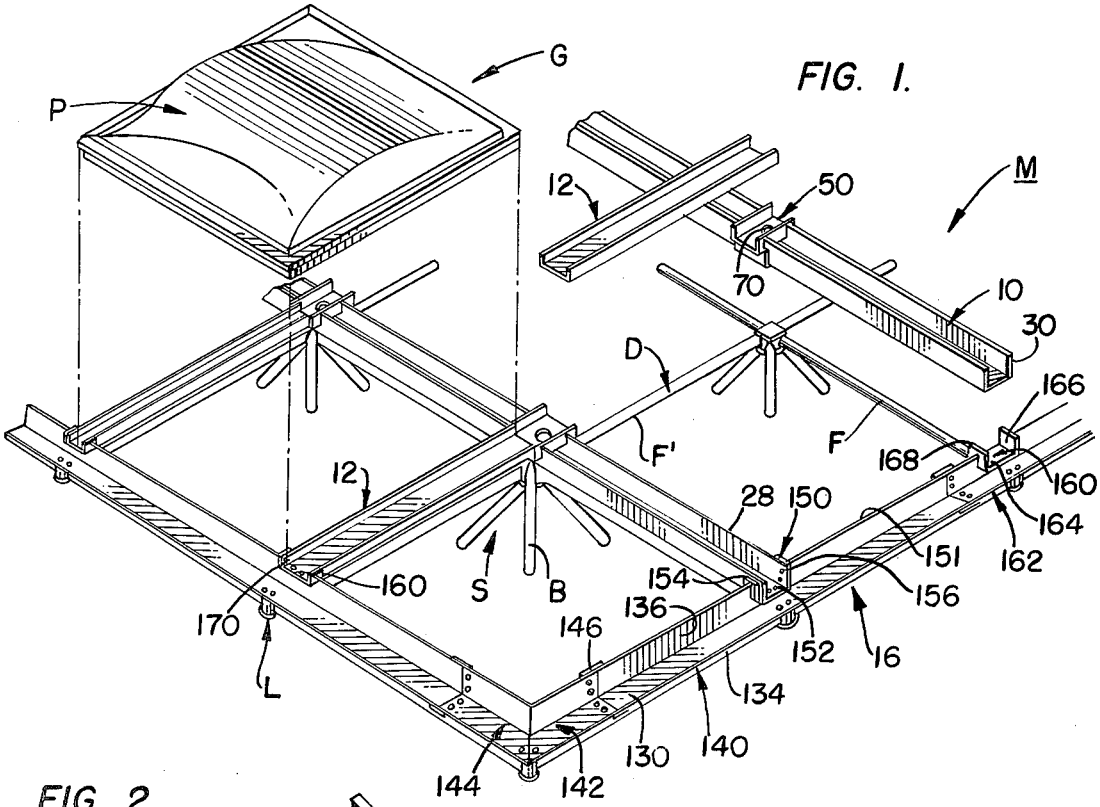
FIG. 1 is a perspective showing a gutter system embodying the teachings of the present invention.

Shown in FIG. 1 is a drainage matrix M for use with a grid system G comprising a plurality of translucent or transparent panels P which may be of acrylic or Plexiglas material, or the like, for use as a skylight, or the like. Other thermal formable plastics, such as polycarbonates, can also be used. The matrix M is useful for both flat and dome grids, and the dome panel is shown only for the sake of illustration and is not intended to be limiting. It is noted that the dome grid can be three-dimensional, or any other suitable or desirable shape.

The grid system includes a plurality of structure S each including a connector hub H (best shown in FIG. 5) having a plurality of inclined branch pipes B connected thereto and a top cap C and a bottom cap C′ connected on each end of the hub. A support platform A is movably connected to the connector hub by a jack screw J (best shown in FIG. 5) as by welding, or the like, to be horizontally disposed. The jack screw includes a top nut N and a bottom nut N′ mounted on opposite ends of the threaded shaft T which is vertically accommodated in the connector hub so that the platform has free marginal edges E spaced above the top of the connector hub to define a gap K between top surface R of the hub top cap C and the undersurface U of the platform. As shown, the platform is welded, or otherwise connected to the top nut N. The function and operation of the jack screw will be evident from the discussion included hereinafter.

As shown in FIG. 1, a plurality of horizontally disposed pipes D are each connected to support hubs and are arranged in a criss-cross square pattern so that first pipes F are axially aligned with each other to extend in a first direction, and second pipes F' are axially aligned with each other to extend in a second direction which is orthogonal to the first direction.

The matrix comprises a gutter system which includes a plurality of primary gutters 10 and a plurality of secondary gutters 12 with the primary and secondary gutters being preferably arranged in an orthogonal pattern.

A perimeter gutter 16 surrounds the matrix.

Each of the primary gutters is preferably shop formed or shop extruded to be an elongate U-shaped channel having a web section 20 and a pair of parallel side walls 22 each integrally connected at one side thereof to one side of the web section and extending upwardly therefrom to unconnected side edges 28 which form top edges in the setup configuration. Each of the primary gutters has opposite ends, such as end 30 shown in FIG. 1, and has aligned notches 32 and 34 defined in the side walls thereof.

Each of the secondary gutters 12 has a web section 36 and a pair of spaced parallel walls 38 integrally attached at one side thereof to opposite side edges of the web section. Each of the walls has a side edge 40 which forms the top edge in the setup configuration. The secondary gutters, like the primary gutters, are preferably shop formed or shop extruded.

Figure 2:
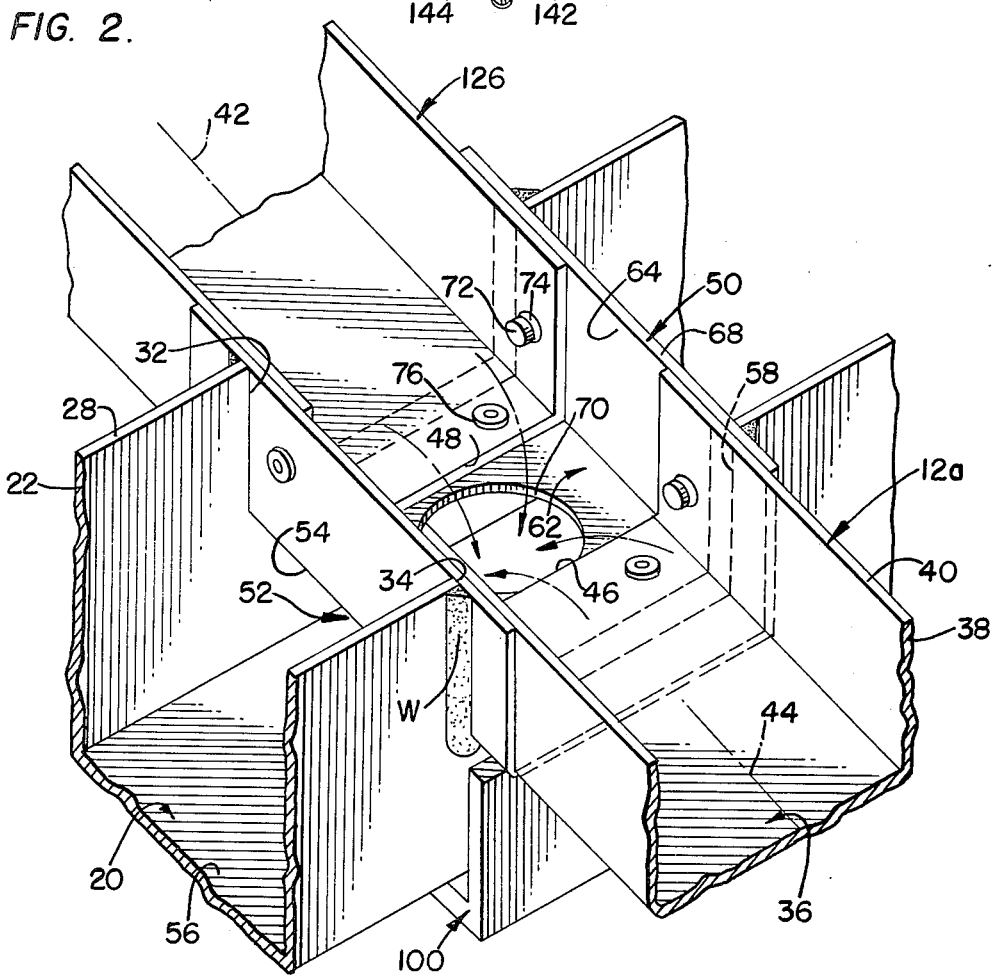
FIG. 2 is a perspective showing a gutter intersection of the gutter system embodying the teachings of the present invention.
Figure 3:
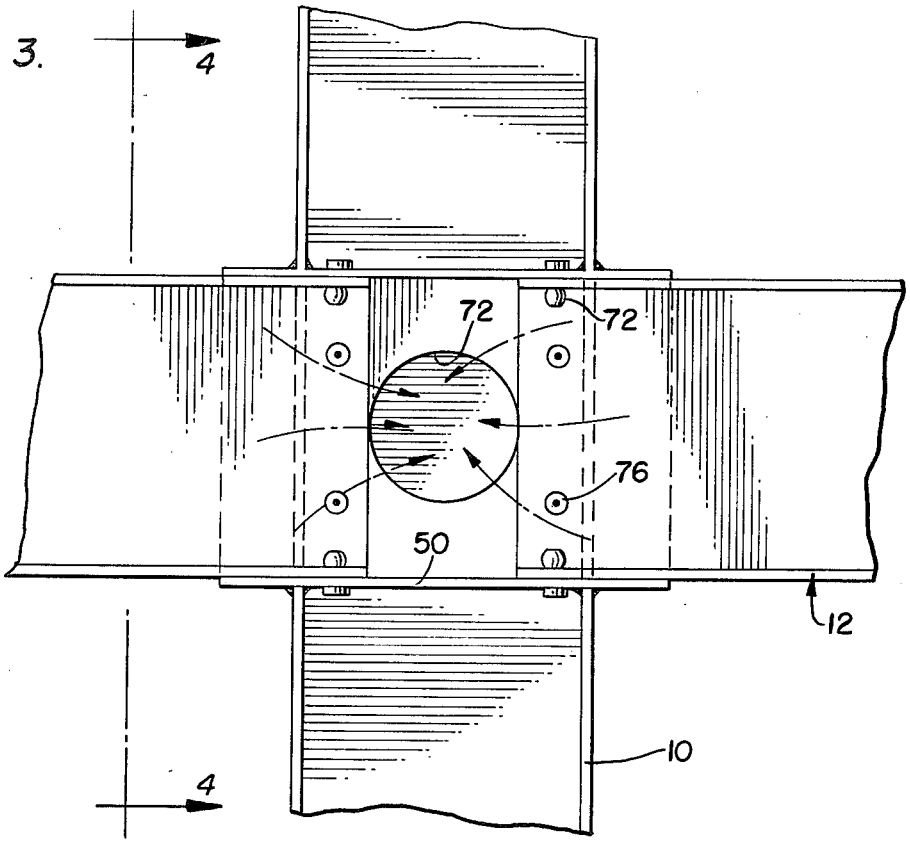
FIG. 3 is a plan view of a gutter intersection in a gutter system embodying the teachings of the present invention.
Figure 4:
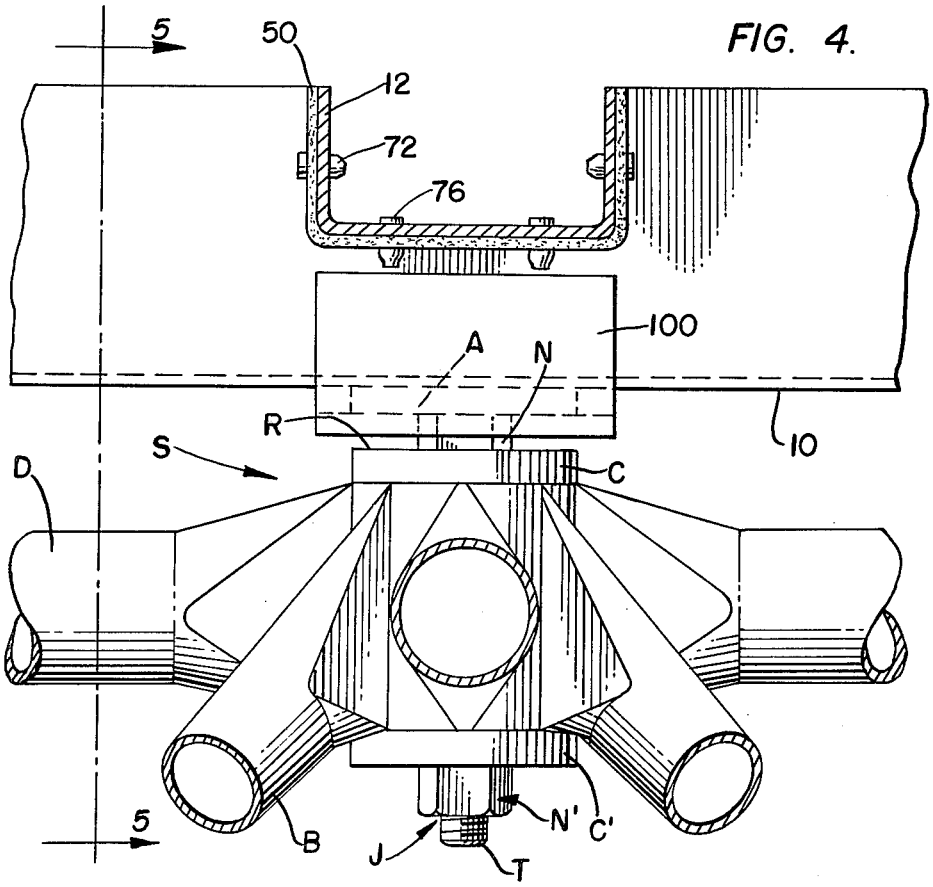
FIG. 4 is a view along line 4—4 of FIG. 3.

As best shown in FIGS. 1 and 2, the secondary gutters are aligned so that longitudinal axes 42 and 44 of the aligned gutters are colinear. Adjacent aligned secondary gutters are spaced from each other so that adjacent ends 46 and 48 of gutters **12*a* and 12*b* shown in FIG. 2** are spaced apart.

A channel connector 50 is preferably shop formed or extruded and is shop welded across the primary gutter wherever a secondary gutter is desired. Each of the channel connectors is shop welded by welds W into the notches 32 and 34 defined in the primary gutter walls, and are each supported above the web section of the primary gutter to define gaps, such as gap 52 between the lower surfaces 54 of each of the channel connectors and upper surface 56 of the corresponding web section 20. Sealant 58 is interposed between each of the connectors and the primary channel walls defining the notches.

The secondary gutters are nestably accommodated in the channel connectors, and each of the channel connectors connects adjacent secondary gutters such as gutters **12*a* and 12*b* together and to a primary gutter, and each has a web section 62 and spaced parallel side walls 64 and a top edge 68 in the setup FIG. 2 configuration. As shown in FIG. 2, each of the connectors 50 has a drain hole 70** defined therethrough near the center thereof for conducting water from the secondary gutter into the primary gutter.

The secondary gutters are nested in the channel connectors and adjacent ends of the secondary gutters are each connected to a connector 50 to be connected together thereby. A plurality of fasteners, such as blind rivets or bolts 72 having Neoprene backed washers 74, or the like, fasten the walls of the gutters to the walls of the connector, and fasteners such as blind rivets 76, or the like, fasten the webs of the gutters to the web of the connector. If a blind rivet is used, a Neoprene backed washer is not required. It is noted that the riveted connections can be made over the primary gutter, and if a leak should occur, the water, or moisture, merely drains into the gutter below. Pop rivets can also be used. Field drilled holes are used to accommodate the fasteners. As shown, the ends of the gutters overlap the ends of the associated connector to form lap joints so the gutters are securely fastened to the connectors.

As above discussed, the notches 32 and 43 of the primary gutters are formed in the side walls to receive the channel connectors. As shown in FIG. 2, the height of the primary gutter side walls as measured from top edge 28 to the web exceeds the height of the secondary gutter side walls as measured from the top edge 40 to the web section, and the notches 32 and 34 have a depth as measured from the top edge 28 to the bottom of the notch matching the height of the secondary channel walls and the height of the connector walls as measured from the top edge 68 to the web section, so that in the setup configuration, the top edges 28, 40 and 68 are all substantially flush and coplanar as shown in FIG. 2.

Figure 5:
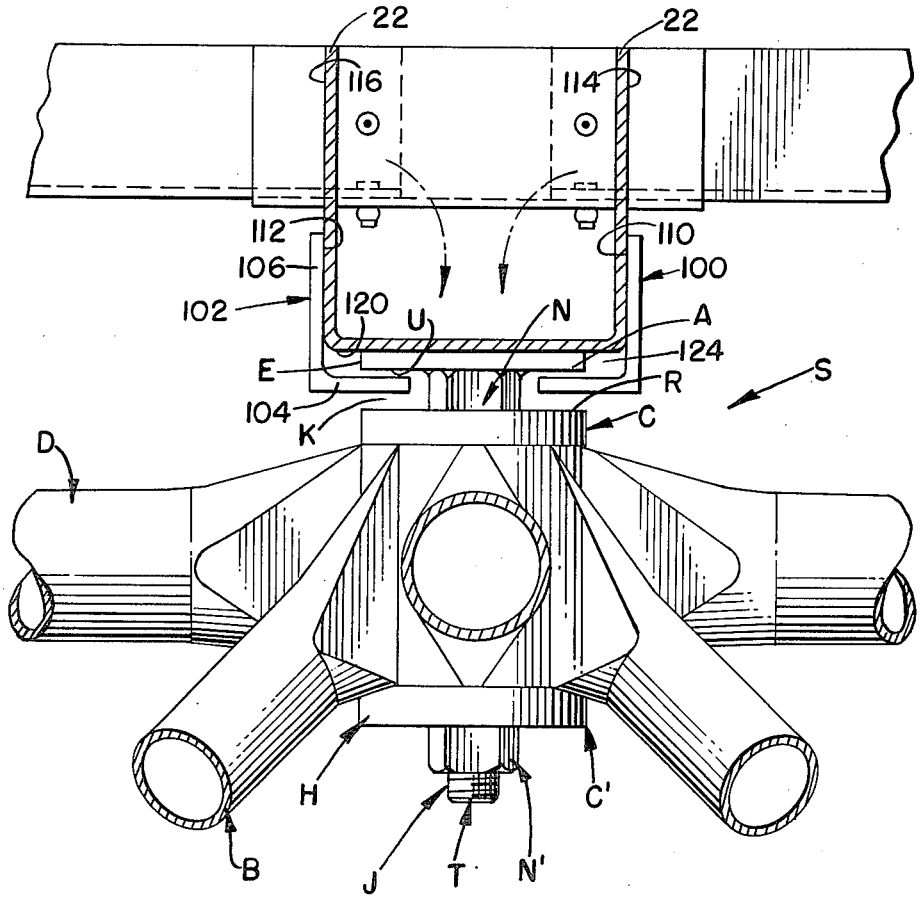
FIG. 5 is a view along line 5—5 of FIG. 4.

Each of a pair of L-shaped support brackets 100 and 102 has a base section 104 and an upright section 106 integrally attached thereto to extend upwardly therefrom in the setup configuration. As best shown in FIG. 5, the upright sections of the support brackets have inner surfaces 110 and 112 attached to outer surfaces 114 and 116 of the primary gutter side walls 22. The support bracket base sections are spaced beneath the primary gutter web section lower surfaces 120 to define a trackway gap 124 therewith. As shown in FIG. 5, the support platform A is slidably received in the trackway gaps 124 with the gutter resting on the platform. Thus, the primary gutters are easily set up by merely sliding the support brackets onto the platforms which have been moved up or down by the jack screws to a desired height. The platforms can be fastened to the gutters as by bolting, welding, or the like, if desired. The jack screw is set to the desired height, then secured in position by the nuts N and N' in a manner usual to jack screws.

The perimeter gutter includes a plurality of sections, each having a base section 130 and a peripheral lip section 134 integrally attached to one side edge thereof. A back wall 136 is integrally attached to the other side of the base section to extend upwardly therefrom. The perimeter gutter sections include elongate sections 140 and corner sections 142 and 144. The end edges of the perimeter gutter sections are in abutting contact and the ends are connected to backing plates 146 to be connected together. A channel-shaped seat bracket 150 is fixed in a notch defined in the back wall section of selected ones of the perimeter gutter sections, and the primary gutters are accommodated in and attached to the seat brackets by fasteners such as blind rivets 152 or the like, as shown in FIG. 1. The top edge 28 of the primary gutters is offset from top edge 151 of the perimeter gutter back walls and is coplanar with top edge 154 of the seat bracket side walls 156.

Further channel-shaped seat brackets, such as bracket 160, are fixed in notches defined in other ones of the perimeter gutter sections, such as section 162. The seat brackets 160 have web sections 164 and side walls 166 extending upwardly from the web section in the setup configuration with a top edge 168 thereon. The secondary gutters are accommodated in and attached to the seat brackets 160 by fasteners, such as blind rivets 170, or the like. The top edges 40 of the secondary gutter walls are offset from the top edges 151 of the perimeter gutter back walls, and are coplanar with top edge 168 of the seat bracket side walls.

The blind rivets 152 and 170 can be set in field drilled holes, if desired. Further supports, such as supports L, or the like, can be used to support and perimeter gutter.

As shown in FIG. 2, water collected in the secondary gutters flows through the drain holes into the primary gutters. Water from the primary gutters and the secondary gutters then empties into the perimeter gutter and is conducted thereby to appropriate conduits, or the like, for disposal thereof.

Figure 6:
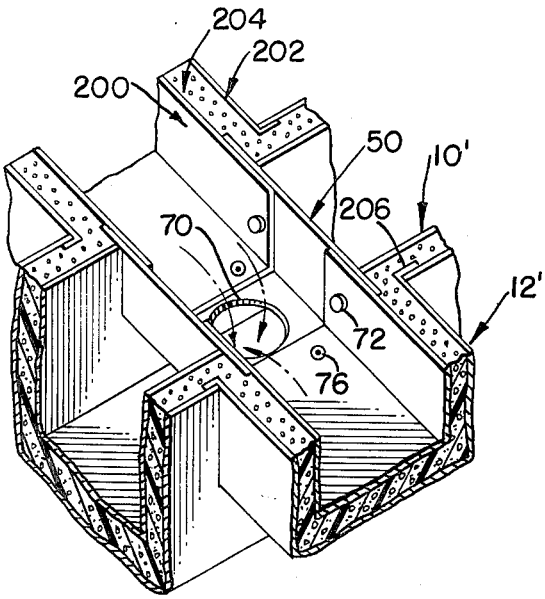
FIG. 6 is a perspective of an alternative for of the gutter intersection of the gutter system embodying the teachings of the present invention.
Figure 7:
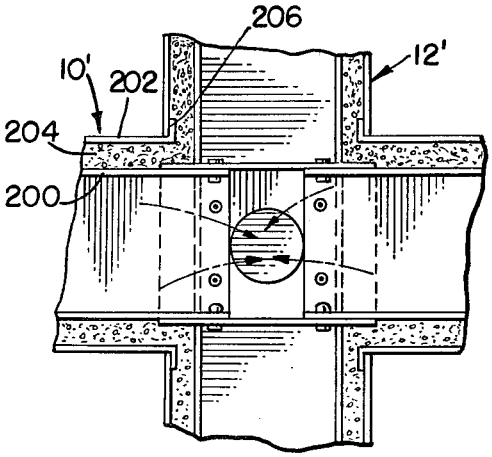
FIG. 7 is a plan view of the FIG. 6 gutter intersection.

An alternative embodiment of the gutters is shown in FIGS. 6 and 7, and the primary and secondary gutters included therein are denoted by the reference numerals 10' and 12', respectively. The gutters of the alternative embodiment include an inner casing 200 and an outer casing 202 with a layer of material 204 interposed therebetween. The inner casing 200 of the gutters corresponds to the gutters of the FIGS. 1–5 embodiment, and the outer casings are connected via flanges, such as flanges 206, or the like, with the secondary gutters being fixed in notches defined in the primary gutter outer casing as shown in FIG. 6. Otherwise, the setup and operation of the alternative embodiment of the gutters of the present invention are similar to the setup and operation of the gutters of the FIGS. 1–5 embodiment. The material 204 can include insulating material, or other such material.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A gutter system for use with skylights or the like comprising:

a supporting means having an elevating means and a platform on said elevating means;

a primary gutter supported on said platform, said primary gutter including a pair of spaced walls each wall having a notch defined therein;

a channel connector nested in said notches and attached to said primary gutter to extend essentially perpendicular thereto, said channel connector having a drain hole defined therein for conducting water into said primary gutter; and a first secondary gutter connected to said channel connector.

2. The gutter system defined in claim 1 wherein said primary gutter is extruded.

3. The gutter system defined in claim 1 further including a second secondary gutter attached to said channel connector to be axially aligned with said first secondary gutter.

4. The gutter system defined in claim 1 further including a perimeter gutter surrounding the gutter system fluidly associated with said gutters to receive water therefrom.

5. The gutter system defined in claim 1 wherein said connector is attached to said primary gutter by welding and a sealant is interposed between said connector and said primary gutter walls.

6. The gutter system defined in claim 1 further including a plurality of primary gutters.

7. The gutter system defined in claim 1 wherein said elevating means includes a jack screw, and attaching means attaching said primary gutter to said platform.

8. The gutter system defined in claim 7 wherein said attaching means includes a pair of brackets slidingly trapping said platform between said brackets and said primary gutter.

9. The gutter system defined in claim 1 wherein said gutters each include an inner casing and an outer casing and a layer of material interposed between said casings.

10. The gutter system defined in claim 9 wherein said layer of material includes insulating material.

11. The gutter system defined in claim 1 wherein said secondary gutter is fastened to said channel connector using fasteners.

12. The gutter system defined in claim 11 wherein said fasteners include blind rivets set in field drilled holes.

* * * * *